United States Patent [19]

Bakx

[11] 4,394,903

[45] Jul. 26, 1983

[54] WRAP-AROUND TYPE PACKAGE FOR BOTTLES

[75] Inventor: Martinus C. M. Bakx, Roosendaal, Netherlands

[73] Assignee: The Mead Corporation, Dayton, Ohio

[21] Appl. No.: 440,786

[22] Filed: Nov. 10, 1982

Related U.S. Application Data

[63] Continuation of Ser. No. 208,205, Nov. 19, 1980, abandoned.

[30] Foreign Application Priority Data

Nov. 15, 1979 [GB] United Kingdom ..... 7939621

[51] Int. Cl.[3] ..... B65D 75/08

[52] U.S. Cl. ..... 206/427; 206/158; 229/31 R; 229/38; 229/40

[58] Field of Search ..... 206/141, 147–149, 206/151–158, 161, 427, 430, 434; 229/37 R, 38, 39 R, 40, 31 R

[56] References Cited

U.S. PATENT DOCUMENTS

| | | | |
|---|---|---|---|
| 2,718,998 | 9/1955 | Bemiss | 229/39 R |
| 2,931,490 | 4/1960 | McGihon | 206/427 |
| 3,373,867 | 3/1968 | Wood | 229/40 X |
| 3,670,950 | 6/1972 | Rossi | 229/40 |
| 3,843,040 | 10/1974 | Locke | 229/38 |
| 3,904,036 | 9/1975 | Forrer | 229/38 X |
| 3,994,398 | 11/1976 | Graham | 206/434 X |
| 4,022,372 | 5/1977 | Graser | 229/40 |
| 4,131,230 | 12/1978 | Koehlinger et al. | 229/40 |
| 4,202,446 | 5/1980 | Sutherland | 206/147 |
| 4,216,861 | 8/1980 | Oliff | 206/427 |

*Primary Examiner*—William Price
*Assistant Examiner*—Gary E. Elkins
*Attorney, Agent, or Firm*—Erwin Doerr

[57] ABSTRACT

This invention relates to a carton of the wrap-around neck-through type for bottles in which at least three parallel rows of apertures are provided in a top wall panel of the carton for receiving neck portions of the bottles. The carton further includes an end closure at opposite ends thereof, each end closure comprises a top flap hinged to the top wall of the carton and to the adjacent side walls, and a pair of base flaps hinged to respective ones of the carton base panels and to the adjacent side walls. The base flaps are secured in overlapping relationship with respect to the top flap.

5 Claims, 3 Drawing Figures

WRAP-AROUND TYPE PACKAGE FOR BOTTLES

This application is a continuation of application Ser. No. 208,205, filed Nov. 19, 1980, now abandoned.

This invention relates to a carton of the wrap-around type which is particularly, although not exclusively, useful for packaging bottles.

One aspect of the invention provides a carton of the wrap-around type adapted for packaging a group of bottles disposed in side-by-side relationship and forming a rectilinear arrangement, which carton comprises top and bottom walls interconnected by spaced side walls for forming a tubular structure with the top and bottom walls parallel to each other and adapted for engagement respectively with a group of suitably sized bottles, the top wall being formed with means defining apertures each to receive a neck portion of a bottle accommodated within the carton, said means being arranged in three or more parallel rows with each row extending parallel to the longitudinal axis of the tubular structure.

According to a feature of the invention the bottom wall may comprise a pair of base panels secured together in overlapping relationship.

According to a further feature of the invention, the opposite ends of the tubular structure may be closed by end closures, each of which includes top and base flaps foldably connected to the top and bottom walls, respectively, of the carton and which are folded towards one another and secured in overlapping relationship. In constructions where this feature is adopted, each end closure may have one top flap foldably joined to the top wall and provided with one or more apertures by which the carton can be gripped and a pair of base flaps foldably joined to respective ones of the base panels and wherein the end closure is closed by securing the two base flaps in overlapping relationship which are in turn overlapped with the said top flap.

Preferably the said top flap includes at each of its ends a gusset panel, each gusset panel being foldably joined to a transverse edge of said top flap and to an edge of the adjacent carton side wall so as to provide a corner construction, the gusset panels being deformable so as to fold inwardly when the said one end panel is folded to close the end closure.

Preferably each of the base flaps includes a gusset panel which is foldably joined to a transverse edge of that base flap and to an edge of the adjacent carton side wall so as to provide a corner construction, each of the gusset panels being deformable so as to fold inwardly when the associated base panel is folded to close the end closure.

In constructions where gusset panels are provided, each gusset panel may include a score line extending diagonally from the corner structure adjacent the top and adjoining side wall of the carton so that when the end closure flaps are folded to close the end closure the portions of each gusset panel on either side of the diagonal score line are folded together and brought into face-to-face relationship inwardly of the end flap.

According to another feature of the invention the means defining apertures in the top wall of the tubular structure may be arranged in four parallel rows. In constructions where this feature is adopted the means comprise apertures struck from the blank, the central two rows of apertures each having a retainer tab hinged adjacent the edge of the aperture and being adapted to be folded upwardly about the hinged edge when the neck of a bottle is passed through the aperture so as to locate beneath the bottle cap. The two centrals rows of apertures may each be provided with wing panels on either side of the hinged retainer tab, the wing panels being adapted to be folded outwardly and defining together with the retainer tab an aperture having "keyhole" shape.

The two outer rows of apertures preferably are oval and struck from the blank such that the major axis of each aperture extends transversely of the top wall.

Preferably each row comprises six apertures so that six bottles may be accommodated in each row.

According to another feature of the invention at least one of the side walls may include a tear away panel which can be removed so as to provide access to the contents of the package.

One embodiment of the invention will now be described with reference to the accompanying drawings, in which.

Figure 1:
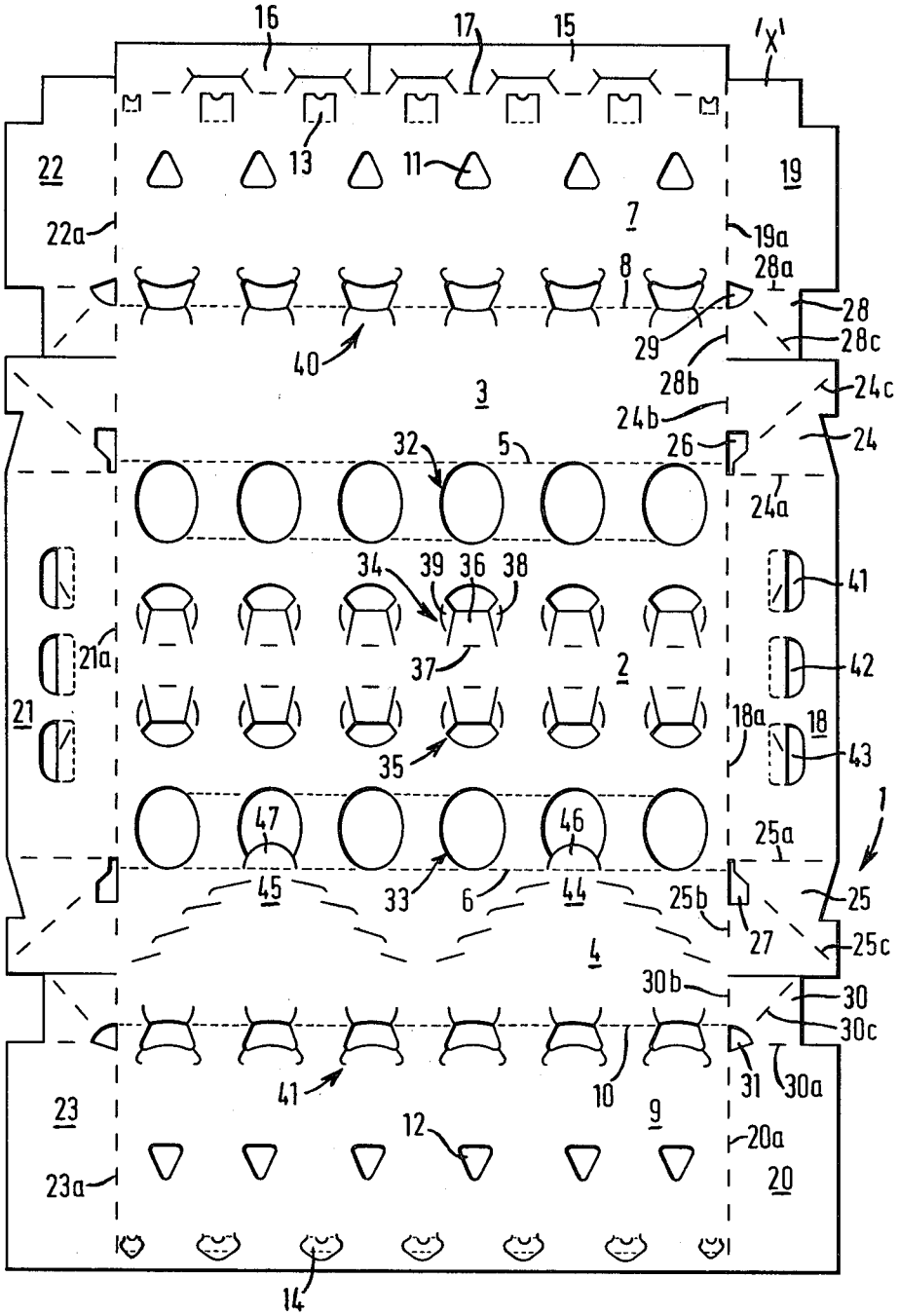
FIG. 1 is a plan view of a blank from which a carton according to this invention is formed.

Referring to the drawings, there is shown in FIG. 1 a paperboard blank 1 for forming a rectilinear carton of the wrap-around type. The blank 1 comprises a central top wall panel 2 for providing a top wall of the carton and a pair of side wall panels 3, 3, respectively, which are contiguous with the central panel 2. Each side wall panel is foldably joined to opposite sides of the central top wall panel 2 along transverse fold lines 5, 6, respectively.

A base panel 7 is foldably joined to the side wall panel 3 along a transverse fold line 8 and a further base panel 9 at the opposite end of the blank is foldably joined to side wall panel 4 along a transverse fold line 10.

As can be seen with reference to FIG. 1 all the fold lines 8, 5, 6, 10 extend transversely across the carton blank 1 and are substantially parallel to one another.

The base panels 7 and 9 are each formed with a series of generally triangular apertures 11, 12, respectively, and a series of locking elements 13, 14, respectively, struck from the blank adjacent the end edges thereof. The functions of the apertures 11, 12 and the locking elements 13, 14 are described below.

The extreme edge of base panel 7 is provided with a pair of adjacent transverse keel panels foldably joined to the base panel 7 along a transverse fold line 17. The keel panels 15 and 16 are each adapted to be folded so as to stand perpendicular to the blank about the fold line 17 and thereby provide a central keel for the carton as will be described later. The fold line 17 is struck in an irregular fashion so that when the keel panels 15 and 16 are folded to stand upright the free edge of base panel 7 is defined by a series of tongues and recesses. The locking elements 13 are located adjacent the edge of each tongue and the keel panels are joined to the base panel 7 along the bases of the recesses.

A series of three end flaps is foldably joined along each longitudinal edge of the blank. One series of end flaps along one of the longitudinal edges of the blank includes a central top flap 18 which is foldably joined to the top panel 2 of the blank along a fold line 18*a*. The top flap 18 is flanked by two base flaps 19, 20 which are foldably joined to the base panels, 7, 9 along fold lines 19*a*, 20*a*, respectively. Similarly a series of end flaps is provided along the opposite longitudinal edge of the blank and comprises a central top flap 21 which is foldably joined to the top panel 2 along a fold line 21*a* and a further pair of base flaps 22, 23 foldably joined to the base panels 7, 9 along fold lines 22*a*, 23*a*, respectively.

The top flap 18 carries at each of its ends a gusset panel 24, 25. The gusset panel 24 is foldably joined to the top flap 18 along a fold line 24*a* and also is foldably joined to the side wall panel 3 along a fold line 24*b*. Adjacent the juncture of fold lines 24*a*, 24*b* the gusset panel 24 is struck with a corner aperture 26 from which a fold line 24*c* extends diagonally across the panel 24. Similarly, gusset panel 25 is foldably joined to the top flap 18 along fold line 25*a* and is foldably joined to the side wall panel 4 along a fold line 25*b* and further includes corner aperture 27 and diagonal fold line 25*c*. As shown in FIG. 1, the fold lines 24*a*, 25*a* are offset with respect to the transverse fold lines 5 and 6 to facilitate folding of the top flap 18 and to facilitate tightening the carton about its ends.

The two other flaps 19, 20 also each have one gusset panel 28, 30, respectively. Base flap 19 includes gusset panel 28 which is foldably joined to the base flap 19 along a fold line 28*a* and is foldably joined to the side wall panel 3 along a fold line 28*b*. The gusset panel 28 abuts gusset panel 24 and includes a corner aperture 29 and a diagonal fold line 28*c*. Similarly, the base flap 20 carries a gusset panel 30 which is foldably joined to the base flap 20 along a fold line 30*a* and is foldably joined to the side wall panel 4 along a fold line 30*b*. The gusset panel 30 abuts gusset panel 25 and further includes corner aperture 31 and diagonal fold line 30*c*. As shown in FIG. 1, fold line 28*a* is aligned with a notional line passing through a row 40 of bottle heel retaining apertures, and fold line 30*a* is aligned with a notional line passing through a row 41 of bottle heel retaining apertures. By this arrangement, folding of the base flaps 19 and 20 is facilitated.

Gusset panels of a similar construction are also provided on the top flap 21 and base flaps 22, 23 along the opposite longitudinal edge of the blank and are not therefore further described in detail.

It will be seen that the top wall panel 2 has struck therefrom four parallel rows of apertures spaced apart between the fold lines 5 and 6. Each row consists of a series of six spaced apertures. The apertures of the two outer rows 32, 33 are generally oval with the major axis of each aperture extending parallel to the longitudinal axis of the blank. The series of apertures in the two center rows 34, 35 are each defined in part by a tab 36 which is hinged at the periphery of the associated aperture along one of its edges 37 to the top panel 2 and a pair of smaller wing tabs 38, 39 which are also hinged at the periphery of the associated aperture.

Figure 3:
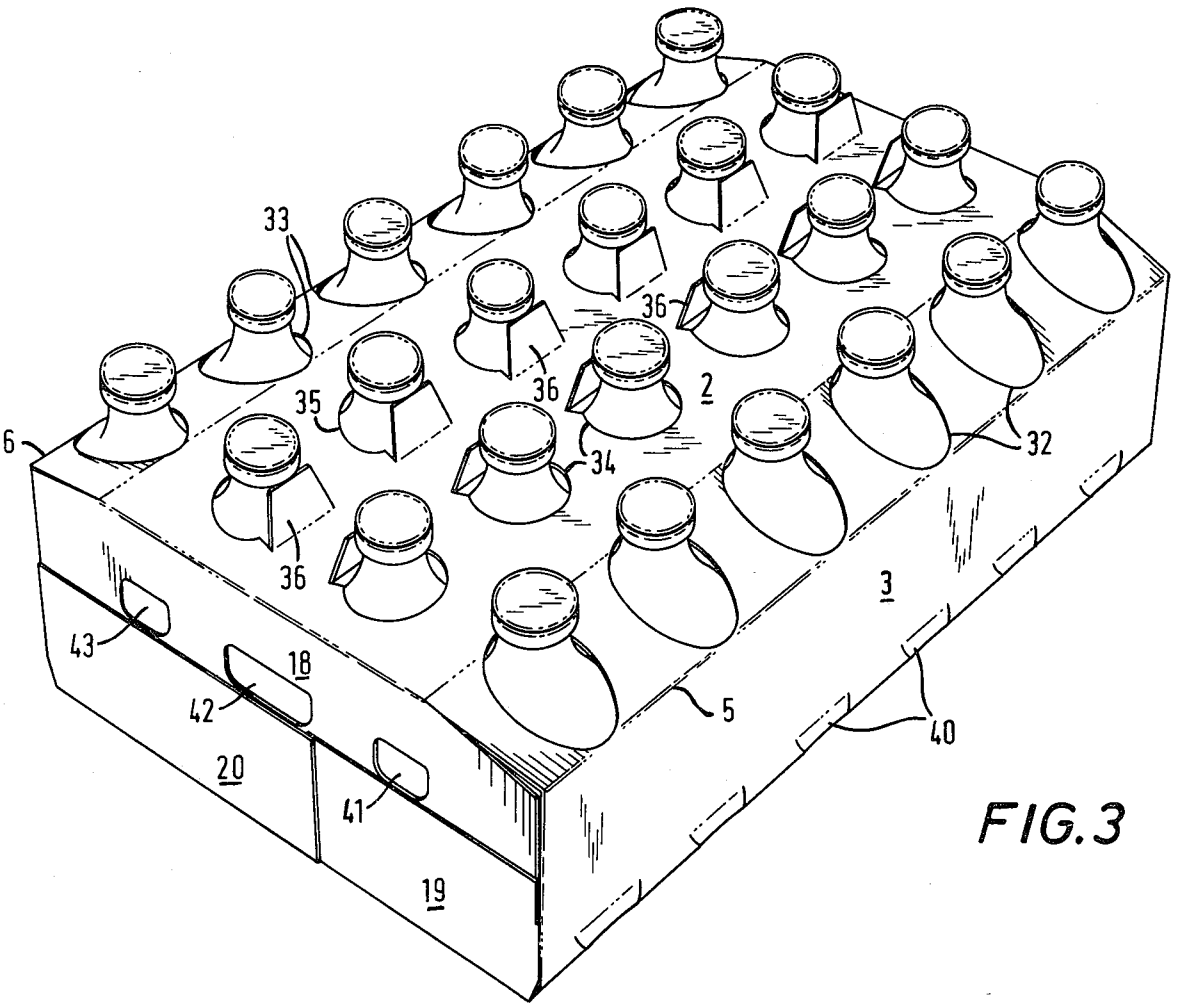
FIG. 3 shows a filled and completed carton according to this invention.

The apertures are spaced apart such that when the partially formed blank 1 is to be finish formed into a carton in a suitable packaging machine each aperture receives a part of the neck of a bottle to be packaged as seen in the completed package of FIG. 3. The blank is pushed over a pre-arranged group of bottles so that the bottle necks pass up through the apertures of each row and in so doing the tabs 36, 38 and 39 of each aperture in the center two rows are displaced upwardly. The free ends of the tabs 36 subsequently engage beneath the caps or crowns of the bottles when the base panels of the carton have been secured and assist in retaining the bottles in position.

Again referring to FIG. 1 of the drawings, it will be seen that along each of the fold lines 8 and 10 is struck a row of shaped apertures 40, 41, respectively. As previously mentioned, the apertures of these rows are adapted to engage with the heels of the bottles to be packaged when the panels 3, 4 are folded downwardly to provide the side walls of the carton. This is achieved as the blank 10 progresses through the packaging machine during which the panels 3, 4 are caused to be folded along fold lines 5, 6, respectively, and subsequently the panels 7, 9 are caused to be folded along fold lines 8, 20 respectively, and brought into overlapping relationship, with the base of the bottles in engagement with the internal faces of the overlapping panels 7, 9. The carton at this stage has a substantially rectilinear tubular configuration. Suitable machine elements then engage the triangular recesses 11, 12 of each of the panels 7, 9 to bring the overlapping end panels into a predetermined position whereby the carton is correctly tensioned around the packaged bottles. Further machine elements engage the series of locking tabs 14 and cause them to be interengaged with the retaining tabs 13 thereby locking together the overlapping end panels 7, 9, respectively, to form the bottom wall of the carton. Such panel interlocking elements are described in more detail in my U.S. Pat. No. 4,093,116.

Figure 2:
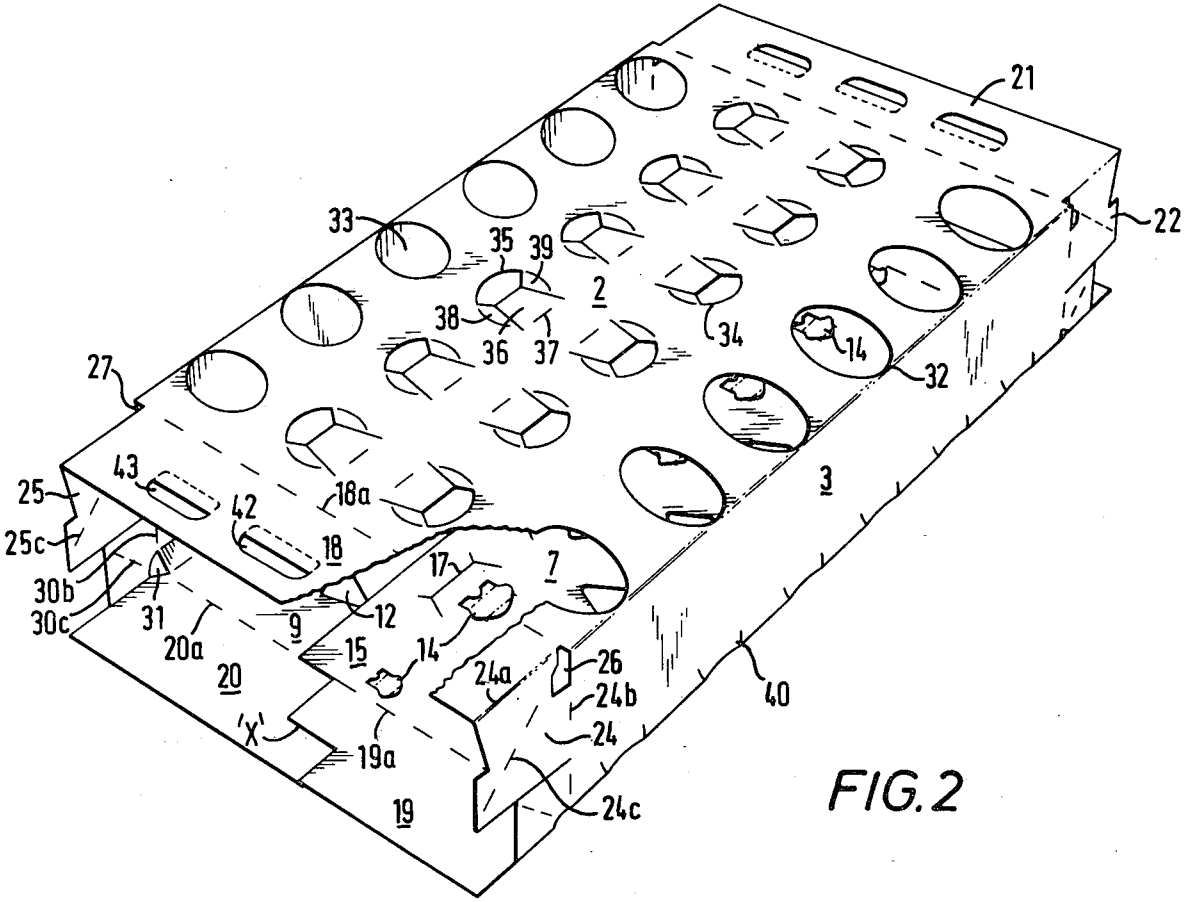
FIG. 2 shows an intermediate stage through which the blank is manipulated to form an open ended carton sleeve.

The carton at this stage has then adopted the sleeve like appearance as shown in FIG. 2 of the drawings, in which the bottom and top walls are substantially parallel and connected together by the spaced substantially parallel side walls with the ends of the carton remaining open. In FIG. 2 the central keel which is made up from panel strips 15 and 16 is shown in the flat position, but in fact at this stage of the packaging operation the keel panels 15, 16 will have been caused to fold along the composite fold line 17 so that the keel panels stand perpendicularly to the base panel 7. Each of the shaped apertures 40, 41 will have received a portion of a heel of a bottle so as to assist, together with the top wall panel apertures, in retaining the bottles in spaced relationship with respect to one another.

In order to close the ends of the package and secure them in position to arrive at the completed package shown in FIG. 3 of the drawings, reference will now be made to the end closure consisting of flaps 18, 19 and 20, it being understood that the closing of flaps 21, 22 and 23 is achieved in a similar manner and is not therefore described further.

To close the carton end shown nearest to the reader in FIGS. 2 and 3 of the drawings, the gusset panels 24, 25 are folded inwardly of the sleeve by causing those gusset panels to be deformed along their diagonal fold lines 24*c*, 25*c*, respectively. Simultaneously, the gusset panel 24 is folded about fold line 24*a* and 24*b* and gusset panel 25 is folded about fold lines 25*a* and 25*b* and the top flap 18 is folded towards the bottom panels of the sleeve about fold line 18*a*. This results in both the gusset panels being tucked in behind the top flap 18 with the panel portions of each gusset panel on either side of the diagonal fold line coming into face-to-face relationship. Adhesive is applied on each of those panel portions so as to hold the top flap 18 in its folded position.

The base flaps 19 and 20 which are foldably joined to base panels 7 and 9, respectively, are then folded upwardly by deforming their respective gusset panels 28, 30, in a manner similar to that just described, so that the flap 20 overlaps a stepped portion "X" of panel 19 and is secured thereto by application of adhesive. The joined and overlapped flaps 19, 20 are then folded to overlap the top flap 18 and are secured thereto by application of adhesive so that the end of the carton is closed in the configuration shown in FIG. 3 of the drawings. Apertures 26, 27, 29 and 31 and the similar corner apertures struck from the opposite closure flaps of the blank are provided to facilitate folding of the flaps.

It will be seen from FIGS. 1 and 3 that the top flap 18 includes three spaced apertures 41, 42, 43 which, in the completed package, provide finger holds by which the carton can be grasped and lifted. As mentioned previously, the opposite end of the carton is closed by closure flaps 21, 22 and 23 in a similar manner described above to complete the package and, of course, the ends of the package may be closed simultaneously.

To facilitate opening the completed package the side wall panel 4 is provided with a pair of tear away sections 44, 45 each of which is defined by spaced cut lines struck from the panel 4. The tear away sections 44, 45 terminate at the top wall in pull tabs 46, 47, respectively, which can be grasped and pulled downwardly to rupture the side wall panel 4 and thereby gain access to the contents of the package.

What I claim is:

1. A carton of the wrap-around type for packaging a group of bottles arranged in a plurality of adjacent rows, which carton comprises top and bottom walls interconnected by spaced side walls forming a tubular strcture with top and bottom walls substantially parallel to one another, top flaps joined to the ends of said top wall and folded downwardly to close at least partially the ends of said carton, gusset panels foldably joined to said top flaps at each end thereof and to adjacent side walls, each of said gusset panels including a diagonal fold line defining foldable gusset panel portions, characterized in that said fold lines by which said gusset panels are joined to the ends of said top flap are substantially parallel to but offset inwardly from the fold lines between said side walls and said top wall and in that said gusset panel portions are folded inwardly into face-to-face contacting relationship with each other whereby the carton is tightened about its top ends as the top flaps are folded downwardly and said gusset panel portions are folded about said diagonal fold lines.

2. The carton according to claim 1 wherein said bottom wall comprises a pair of base panels foldably joined to respective ones of said side walls and secured together in overlapping relationship and base flaps joined to the ends of said base panels and folded upwardly in overlapping relationship with respect to the adjacent top flap.

3. The carton according to claim 2 further comprising foldable gusset panels interconnecting said base flaps with the adjacent side walls.

4. A blank for a wrap-around carton adapted to enclose a plurality of bottles, comprising in series a first base panel, a first side wall panel, a top panel, a second side wall panel and a second base panel, hinged one to the next along transverse fold lines, said top panel including means defining at least three parallel rows of apertures, each row extending transversely of the blank, and end closure means provided along each longitudinal edge of said blank, each of said end closure means comprising a top flap joined to said top panel along a hinge line and including a gusset panel at each of its ends, said gusset panels being foldably joined to respective transverse edges of said top flap and to respective longitudinal edges of the adjacent first and second side wall panels, respectively, each of said gusset panels having two gusset panel portions foldable about a diagonal fold line, characterized in that the fold lines by which said gusset panels are foldably joined to the top flap are each substantially parallel to but offset inwardly with respect to the transverse fold line between the adjacent side wall panel and top panel and in that said diagonal fold line extends outwardly from a point adjacent the juncture of said offset fold line with the hinge line associated with said top flap, whereby the carton is tightened about its ends when said top flaps are folded downwardly and said gusset panel portions are simultaneously folded into face-to-face contacting relationship with each other and inwardly as the carton is formed.

5. The blank according to claim 4, further comprising a first and a second base flap hinged to said first and second base panel, respectively, gusset panels foldably joined to said first base flap along one transverse edge and also being foldably joined to the adjacent longitudinal edge of said first side wall panel, and gusset panels foldably joined to said second base flap along one transverse edge and also being foldably joined to the adjacent longitudinal edge of said second side wall panel, both of said gusset panels being deformable so as to fold inwardly when said base flaps are folded into overlapping relationship with said top flaps.

* * * * *